United States Patent [19]

Boots

[11] Patent Number: 5,071,025

[45] Date of Patent: Dec. 10, 1991

[54] PACKAGE FOR TRANSPORTING AND STORING BULK GOODS

[76] Inventor: Gerardus A. M. Boots, Boskriek 72, 5401 LP Uden, Netherlands

[21] Appl. No.: 531,028

[22] Filed: May 31, 1990

[30] Foreign Application Priority Data

Jun. 6, 1989 [FI] Finland ..... 892756

[51] Int. Cl.[5] ..... B65D 90/04

[52] U.S. Cl. ..... 220/410; 383/104; 383/119

[58] Field of Search ..... 220/402, 410, 403; 383/104, 119

[56] References Cited

U.S. PATENT DOCUMENTS

| | | | |
|---|---|---|---|
| 2,973,119 | 2/1961 | Parker | 220/402 |
| 4,834,255 | 5/1989 | Boots | 220/410 |
| 4,901,885 | 2/1990 | Boots | 220/402 |

FOREIGN PATENT DOCUMENTS

| | | |
|---|---|---|
| 57382 | 4/1980 | Finland . |
| 61174 | 2/1982 | Finland . |
| 68590 | 6/1985 | Finland . |

*Primary Examiner*—William I. Price

[57] ABSTRACT

The invention concerns a package for transporting and storing bulk goods, said package comprising an outer package (11) and an inner package (12). The inner package (12) comprises an outer frame (13) and an inner frame (14) which are at least partly attached to each other. The length of the outer frame (13) of the inner package (12) is greater than or equal to the length of the inner frame of the outer package (11), and the length of the inner frame (14) of the inner package (12) is smaller than or equal to the length of the outer frame of the outer package (11). The internal pressure ($P_1$) prevailing in the package (10) is received as tension force ($F_2$) acting on the circumference of the outer package (11), said tension force producing a resultant force ($F_3$) acting from the corners of the outer package (11) on the package (11), said resultant force ($F_3$) reducing the tensions prevailing in the inner package ( 12) in that the juncture points (19) of the inner frame (14) and the outer frame (13) of the inner package (12) are substantially free of stresses.

16 Claims, 4 Drawing Sheets

PACKAGE FOR TRANSPORTING AND STORING BULK GOODS

Figure 1:
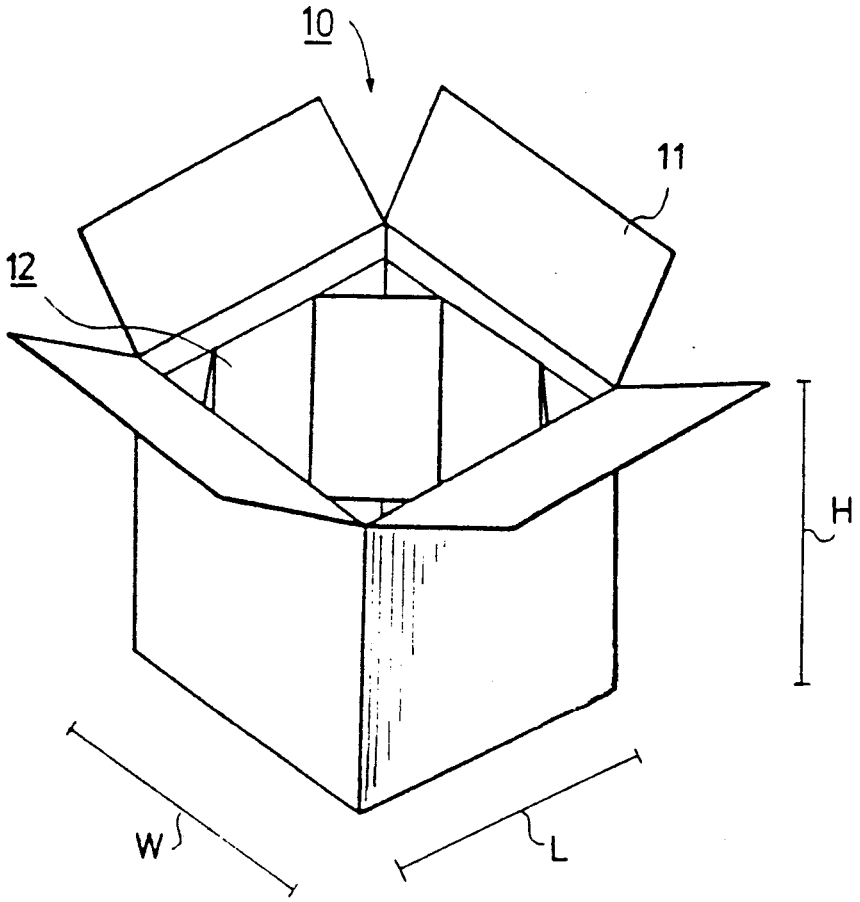

The present invention concerns a package for transporting and storing bulk goods, said package comprising an outer package and an inner package.

As regards the state of art, reference is made to the Dutch patent applications Nos. 8601365 and 8700063. Said publications disclose a package for freely flowing substances, said packages comprising a tubular outer envelope and a tubular inner member. The circumference of the inner members of said packages known in the art is smaller than that of the outer envelope, and the inner member is attached to the tubular envelope on at least four points spaced in the direction of the frame, so preventing bulging out of the tubular envelope. According to Dutch patent application No. 8601365, the inner member is attached to the outer envelope in the longitudinal direction of the tubular member, the length of the inner member being 30 to 100 per cent of the selected height of the package. In the package disclosed in the Dutch patent application No. 8700063, reinforcing means are used, said means extending over the entire length of the package, and being in contact with the inner member.

As regards the state of art, reference is made to the previous Finnish patent applications Nos. 61174, 57382 and 68590, in which packages used for maxibags are described. This kind of maxibags are used for transporting and storing bulk goods, and the quantity of bulk goods varies in general from a few hundred kilos to several tons. The maxibags are in general lifted at their upper end with the aid of lifting loops arranged thereon. However, such designs are known in the art in which the maxibag can equally be lifted at the bottom end. In certain maxibag designs no lifting loops are used, but the open upper end of the maxibag is gathered with a rope and the lifting of the maxibag is carried out with a lifting link produced in the rope. In certain designs, the lifting loops of the maxibag are formed from straight lengthening pieces of the maxibag envelope connected with sown seams to one another. Such maxibag designs are also known in which no sown seams have been made in lifting loops. This kind of maxibags are produced from a bent-over material piece seamed on the envelope and the bottom, whereby lifting loops, provided with no seams at all, are formed in the upper part.

The object of the invention is to further improve the designs known in the art in that the strength of the package increases considerably, so that no risk of the package being broken exists during transporting, storing or lifting.

The aim of the invention is to provide a package of a novel type for transporting and storing various bulk goods.

For achieving the aims presented above and those to be revealed below, the package of the invention is mainly characterized in that the inner package comprises an outer frame and an inner frame for which means are provided for connecting the inner frame to the outer frame and that when the package is filled the perimeter of the outer frame of the inner package is greater than the perimeter of the inner frame of the outer package, and that the perimeter of the inner frame of the inner package is smaller than the perimeter of the inner frame of the outer package, in which case the internal pressure prevailing in the package is received as tension force acting upon the frame of the outer package, said tension force causing a resultant force acting on the package from the corners of the outer package, said resultant force thereby reducing the tensions existing in the inner package at the connecting means of the inner frame of the inner package and the outer frame to make them substantially free of stresses.

The package of the invention is such in structure that it can be lifted so that its bottom shape is not changed or that there is no risk of its walls being broken. The package of the invention is also stronger than the packages known in the art; hence, no danger of its becoming broken during transport exists.

The package of the invention is such in structure that when stacking said packages one on top of one another no danger exists of the packaging material being torn on the sides of the package, which facilitates the storing arrangements.

The invention is now described in detail, reference being made to the figures of the drawing enclosed in which FIG. 1 presents schematically an advantageous embodiment of the package of the invention.

Figure 2:
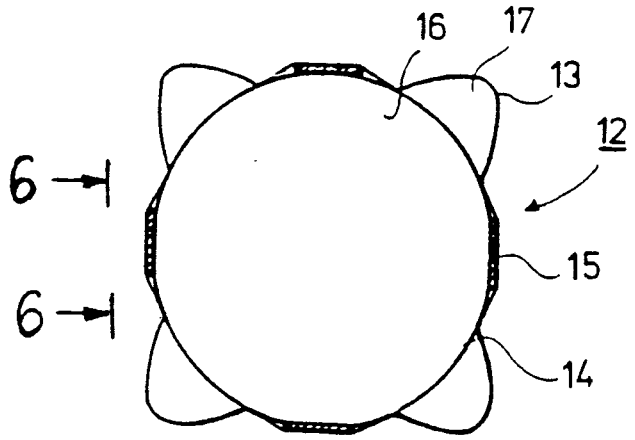

FIG. 2 presents schematically an advantageous embodiment of the inner package of the package of the invention.

Figure 3:
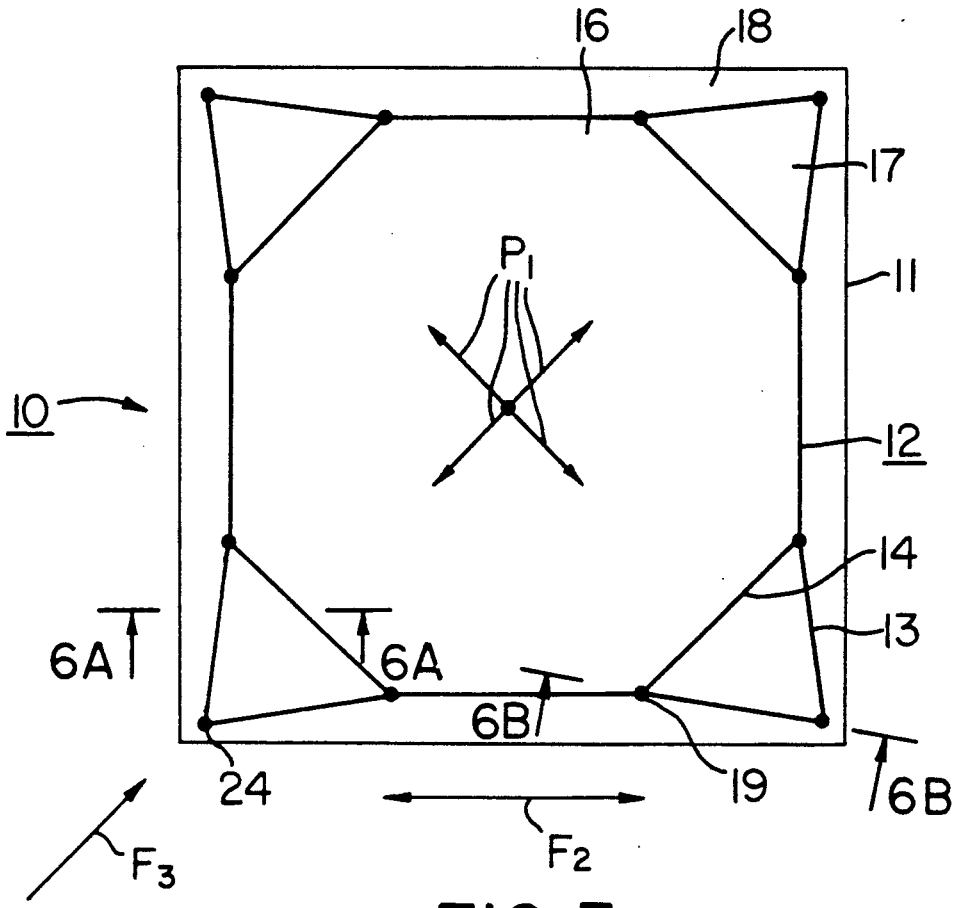
Figure 3:
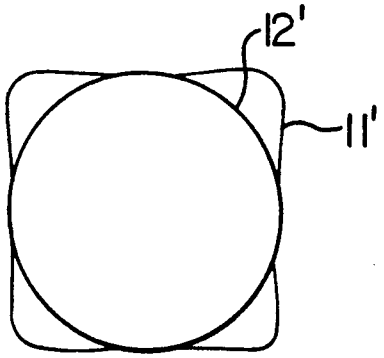

FIG. 3 presents schematically the cross-section of the package of the invention in height direction.

FIG. 3' presents schematically the cross-section of a package design illustrating the state of art in height direction.

Figure 4:
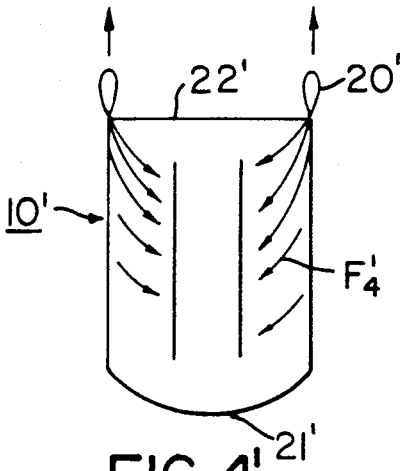
Figure 4:
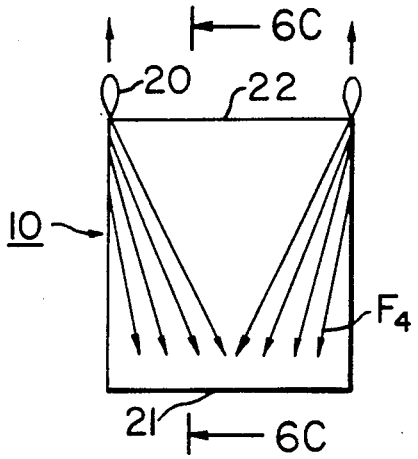
Figure 5A:
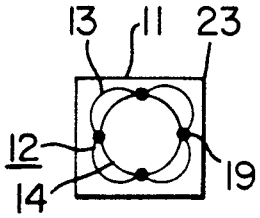
Figure 5B:
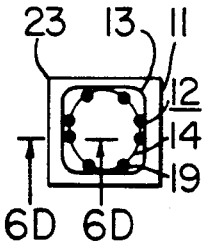
Figure 5C:
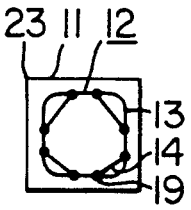
Figure 5D:
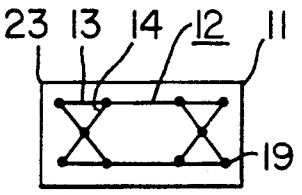
Figure 5E:
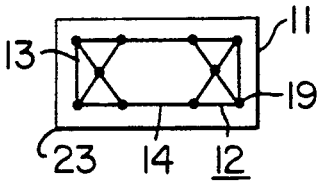
Figure 5F:
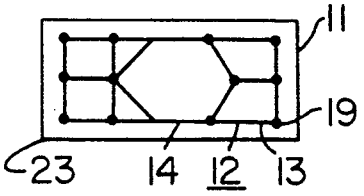

FIG. 4' presents schematically a state-of-art package when said package is being lifted.

FIG. 4 presents the package of the invention schematically when said package is being lifted, and FIGS. 5A–5F present schematically various versions of the vertical cross-section of the package of the invention.

Figure 6:
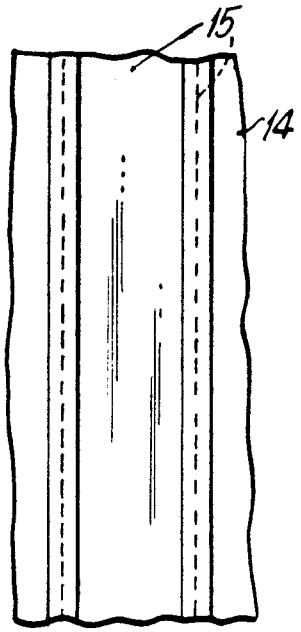

FIG. 6 taken along lines 6—6 of FIG. 2.

Figure 6A:
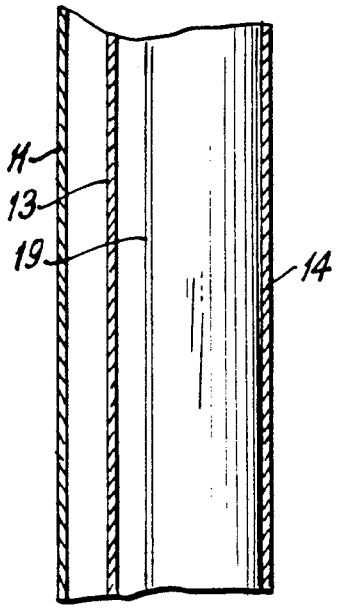

FIG. 6A taken along lines 6A—6A of FIG. 3.

Figure 6B:
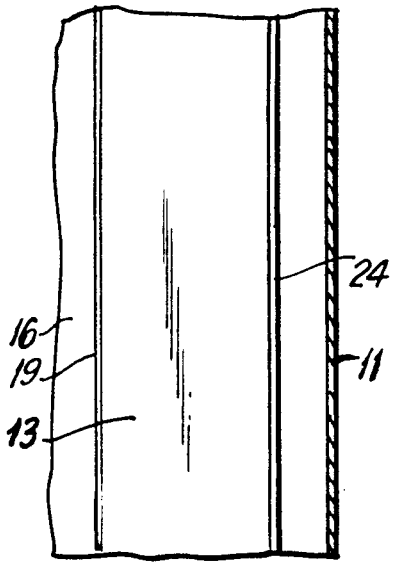

FIG. 6B taken along lines 6B—6B of FIG. 3.

Figure 6C:
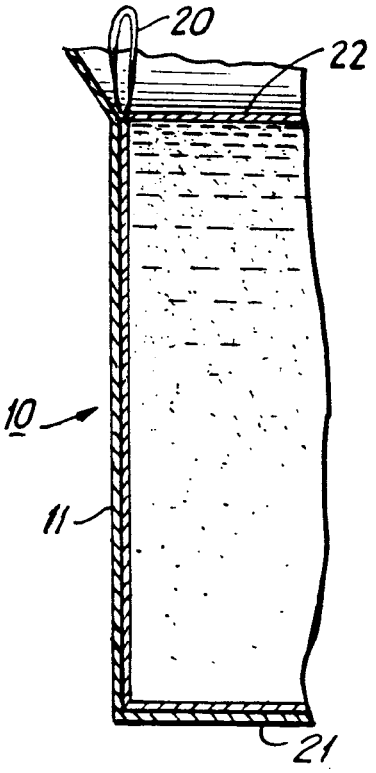

FIG. 6C taken along lines 6C—6C of FIG. 4 (inner and outer package).

Figure 6D:
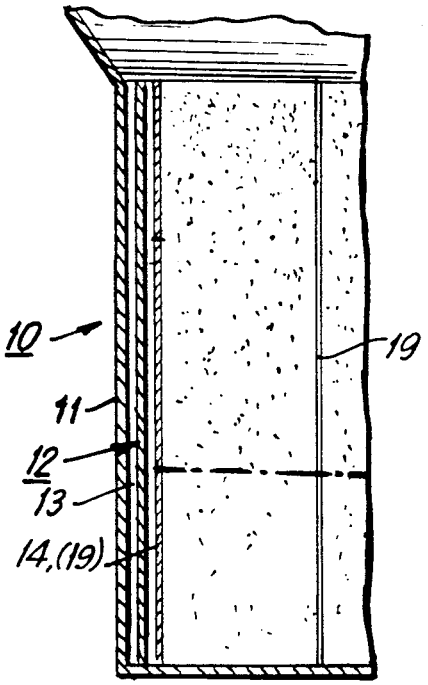

FIG. 6D taken along lines 6D—6D with dot dash line showing 33%.

As shown in FIG. 1, the package 10 of the invention comprises an outer package 11 and an inner package 12. In the figure, the package width is indicated by letter W, length by L and height by H.

In FIG. 2 is presented an embodiment example of the cross-section of the inner package 12 of the package of the invention in height direction. As shown in FIG. 2, the inner package comprises an outer frame 13 and an inner frame 14. The space defined between the outer frame 13 and the inner frame 14 is indicated by reference numeral 17 and the space inside the inner frame 14 of the inner package 12 by reference numeral 16. The package of the invention may, if needed, be provided with reinforcements 15 to support the inner package 12 in height direction.

In FIG. 3 is presented an embodiment example of the cross-section of the package 10 of the invention in height direction. The package 10 comprises an inner package 12 within an outer package 11, said inner package being composed of an outer frame 13 and an inner frame 14. The outer frame 13 and the inner frame 14 of the inner package 12 are at least in part attached to one another. The connecting means of the outer frame 13 and the inner frame 14 of the inner package 12 are indicated by reference numeral 19, and the corner points of the outer frame 13 of the inner package 12 by reference numeral 24.

EXAMPLE 1

The resistances of the package presenting the state of art, shown in FIG. A, and of the package of the invention, shown in FIG. 3, to internal pressure were mutually compared.

The material of the package used to illustrate the state of art was made of polyethene, the volume of the package being 1250 liter bulk goods. A state-of-art bag at 2000 kg pressure stretched over 10%. When increasing the pressure to 2400 kg, one of the seams between the outer package 11' and the inner package 12' broke entirely.

In a similar test, the package of the invention comprises an outer package 11 made of a standard woven FIBC bag, and an inner package 12 with no top part and bottom. In the test, the perimeter of the frame of the outer package 11 of the package 10 was about 2% smaller than the- length of the outer frame 13 of the inner package 12. At 10000 kg pressure, the stretch of the package 10 of the invention was only about 1%. At that pressure one of the seams of the outer package 11 began to deteriorate.

The internal pressure $P_1$ prevailing in the package 10 of the invention is received as a tension force $F_2$ acting on the outer package 11. Said tension force $F_2$ yields a resultant force $F_3$ which enters through the corners of the outer package 11 as shown in FIG. 3. The resultant force $F_3$ decreases the stresses existing in the inner package 12 in that the juncture points 19 are substantially free of stresses.

It is taught by the invention to transfer in the package 10 of the invention the stresses in that all juncture points 19 in the inner package 12 are more or less free of stresses.

EXAMPLE 2

In a reference test, the resistances of the package 10 of the invention and a package 10' of the state of art were compared as to their dynamic loading. When lifting the package 10', illustrating the state of art, as is shown in FIG. B, the forces are transmitted from the lifting loops 20' directly to the connection points of the inner package. As shown by arrows, the forces $F_4'$ cause torsional loading in the juncture points, and said loading becomes utterly critical. In addition, in the package 10' of the state of art, the package bottom 21' is, while being lifted, formed rounded in that it will not return straight when the package 10' is placed back on the ground, which makes the package very unbalanced.

When lifting the package 10 of the invention, as in FIG. 4, from the lifting loops, the loading forces $F_4$ are formed as shown by arrows. Hereby, the forces $F_4$ are mediated to the bottom 21 of the outer package, so that no torsional forces are mediated to the juncture points of the inner package. In addition, the bottom 21 of the package of the invention remains straight during lifting, as a result that the package remains steadily upright when placing it back on the ground.

FIGS. 5A–5F present schematically various forms of the vertical cross-section of the package of the invention when package is filled up. When the package has been made from a very thin or reticulatedly woven material, the corners 23 of the package are formed round whereas most of the walls of the outer package 11 are even. When for-manufacturing the package the material used is a rather rigid material, completely even packages with no rounded corners 22 are produced.

The package of the invention has even walls and a square or rectangular vertical cross-section, and the package of the invention is resistant to static and dynamic forces so that no resultant force is focused at the juncture points 19 of the inner package.

The perimeter of the inner frame 14 of the inner package 12 is smaller than the perimeter of the outer frame of the outer package 11 comprising the width W and the length L when the package 10 is filled. The perimeter of the outer frame 13 of the inner package 12 is greater than the perimeter of the inner frame of the outer package 11. When using the package of the invention, the inner package can be bent over the outer package.

In the package 10 of the invention, for the joining material of the juncture points 19 of the outer frame 13 and the inner frame 14 of the inner package 12 any material may be used. This is due to the fact that no forces are substantially focussed on the juncture points 19. For instance, a piece of reticulated material or paper can easily be affixed to wood or plastic e.g. with self-adhesive tape. In other words, various materials can be combined using joining methods known in the art in that for each material an appropriate joining method is selected.

When using the package of the invention, the juncture points in the corner points 24 of the outer frame 13 of the inner package 12 need not be closed when the package is filled with dry goods. This is due to the fact that the outer package 11 closes said points automatically during the filling. An advantage to be thus gained is easier bending of the unfilled inner package to become even.

The inner package 12 in the package 10 of the invention may be at least in part attached to the outer package 11. The inner package 12 may also be wholly disconnected from the outer package 11. The mutual joining of the inner package 12 and the outer package 11 as well as its quantity are selected in accordance with the package and applications.

The height of the outer package 11 of the package 10 of the invention is at least 33% of the height of the package when filled so that the filling material settles on the bottom. No maximum limitation in height is set for the package of the invention. The height of the outer frame 13 of the inner package 12 is at least 33% of the height of the package 10 when filled up. In this case, the outer package 11 is required to be at least 100% of the package height. The height of the inner frame 14 of the inner package 12 is at least 33% of the height of the package but no maximum limit is set for the height.

When using the inner package 12 for dry goods, the package need not be provided with a bottom 21 or a lid 22. The inner package 12 presses automatically against the outer package 11 when filled up.

When using the package of the invention for liquids, the inner package 12 is required to comprise at least a bottom 21.

When using the package 10 of the invention for transporting and storing dry goods, the entire cross-sectional area of the package 10 can be filled. What is most important is that the regions 17 and 16 of the inner package are filled up to at least 30%.

When using the package of the invention for liquids, only the regions 17 and 16 of the inner package 12 are filled, in which case the inner package 12 must be provided with a bottom 21.

The package of the invention may be used as an application for a plurality of different packaging designs. The inner package of the invention may be used e.g. as the inner bag in a large-size, or maxibag. Hereby, the shape of the inner package becomes rounded.

The invention is described in the foregoing referring merely to some advantageous embodiments thereof. Therefore, the invention is not intended to be confined in any way to concern only the above examples, and a plurality of variations and modifications are feasible within the scope of the inventive idea determined by the claims presented below.

I claim:

1. A package for transporting and storing bulk goods, said package (10) comprising an outer package (11) and an inner package (12), characterized in that the inner package (12) comprises an outer frame (13) and an inner frame (14), for which means are provided for connecting the inner frame to the outer frame, the perimeter of the outer frame (13) of the inner package (12) being greater than the perimeter of the outer package (11), and the perimeter of the inner frame (14) of the inner package (12) is smaller than the perimeter of the outer package (11), whereby when said bulk goods are added to said inner package the internal pressure ($P_1$) prevailing in the package (10) is received as tension force ($F_2$) acting on the frame of the outer package (11), said force producing a resultant force ($F_3$) acting from the corners of the outer package (11) on the package (10), said resultant force ($F_3$) thereby reducing the tensions prevailing in the inner package (12) at the connecting means of the inner frame (14) and the outer frame (13) of the inner package (12) to make them substantially free of stresses.

2. A package according to claim 1, characterized in that, when the package is lifted, the forces ($F_4$) acting on the package (10) are transmitted to the bottom (21) of the outer package (11) in that the bottom (21) of the package (10) remains substantially straight when the package is lifted and placed back on the ground.

3. Package according to claims 1 or 2 characterized in that, when liquids are packaged, the inner package (12) has at least a bottom (21).

4. Package according to claim 3, characterized in that, when liquids are packaged, only areas (17 and 16) of the inner package (12) are filled.

5. Package according to claim 1 or 2, characterized in that, when packaging dry goods, the package (10) is filled over its entire cross-sectional area, and that at least 30% of the areas (17 and 16) of the inner package (12) are filled.

6. Package according to claim 1 or 2, characterized in that the inner package (12) is at least partly attached to the outer package (11).

7. Package according to claim 1 or 2, characterized in that the inner package (12) of the package (10) is an inner bag of a large-size bag.

8. Package according to claim 2, characterized in that the height of the outer package (11) is at least 33% of the height of the package (10) when filled in that the filling material settles on the bottom (21) of the package (10).

9. Package according to claim 2, characterized in that the height of the outer frame 13 of the inner package (12) is at least 33% of the height of the package (10) when filled, in which case the height of the outer package (11) is equal to the height of said package.

10. A package according to claim 1, wherein said outer package is a box.

11. A package according to claim 10, wherein said inner package is a bag.

12. A package according to claim 10, wherein said inner package is a box.

13. A package according to claim 1, wherein said outer package is a bag.

14. A package according to claim 13, wherein said inner package is a bag.

15. A package according to claim 13, wherein said inner package is a box.

16. A package according to claim 13, wherein said inner package is a box.

* * * * *